US006736080B2

(12) United States Patent
Armstrong

(10) Patent No.: US 6,736,080 B2
(45) Date of Patent: May 18, 2004

(54) SEAGOING VESSELS

(75) Inventor: Neville A. Armstrong, Coogee (AU)

(73) Assignee: Austal Ships Pty. Ltd., Henderson (AU)

( * ) Notice: Subject to any disclaimer, the term of this patent is extended or adjusted under 35 U.S.C. 154(b) by 0 days.

(21) Appl. No.: 10/330,480

(22) Filed: Dec. 30, 2002

(65) Prior Publication Data

US 2003/0136322 A1 Jul. 24, 2003

(51) Int. Cl.[7] ..... B63B 1/00
(52) U.S. Cl. ..... 114/61.11; 114/61.14
(58) Field of Search ..... 114/39.26, 61.1, 114/61.11, 61.14, 123

(56) References Cited

U.S. PATENT DOCUMENTS

| | | | | |
|---|---|---|---|---|
| 4,919,063 A | * | 4/1990 | Hall et al. | 114/61.14 |
| 5,054,410 A | * | 10/1991 | Scarborough | 114/39.26 |
| 5,529,009 A | | 6/1996 | Faury et al. | |
| 6,000,355 A | | 12/1999 | Hall | |
| 6,070,544 A | | 6/2000 | Finley | |

FOREIGN PATENT DOCUMENTS

| | | |
|---|---|---|
| EP | 0 901 957 A2 | 3/1999 |
| WO | WO 94/20359 | 9/1994 |
| WO | WO 97/10988 | 3/1997 |
| WO | WO 99/00291 | 1/1999 |
| WO | WO 99/41141 | 8/1999 |
| WO | WO 99/57006 | 11/1999 |
| WO | WO 99/62760 | 12/1999 |
| WO | WO 00/07874 | 2/2000 |

* cited by examiner

*Primary Examiner*—Stephen Avila
(74) *Attorney, Agent, or Firm*—Stites & Harbison, PLLC; Ross F. Hunt, Jr.

(57) ABSTRACT

A seagoing vessel having a length of between 45 and 175 meters and designed to operate at speeds of between 25 and 70 knots, the vessel comprising a single main hull with stabilising amahs positioned on either side, wherein the hydrostatic value of GM determined in the transverse plane lies between 0.5 and 5 meters, the vessel being shaped above the designed waterline such that the righting lever (GZ) curve as the vessel heels meets the following requirements:

the area (b) bounded by the GZ curve plotted on the heeling axis between the angle of flooding and the heeling lever associated with a specific gust of wind is greater in value than the area (a) bounded by the GZ curve plotted on the heeling axis between the heeling lever associated with the specific gust of wind and an angle associated with the amount of roll of the vessel to windward under the action of the waves.

13 Claims, 12 Drawing Sheets

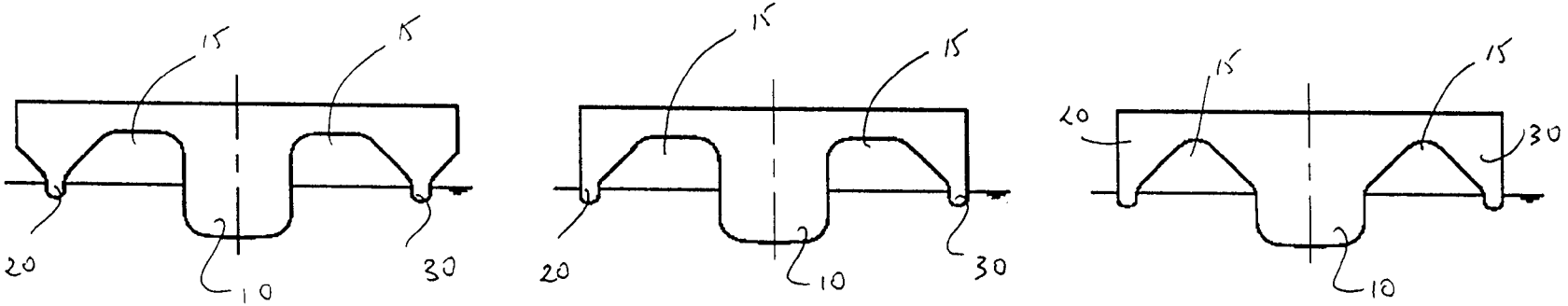
FIG. 6a
FIG. 6b
FIG. 6c
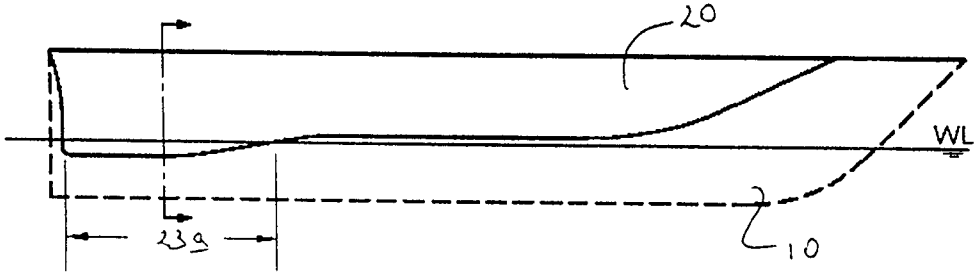
FIG. 7a
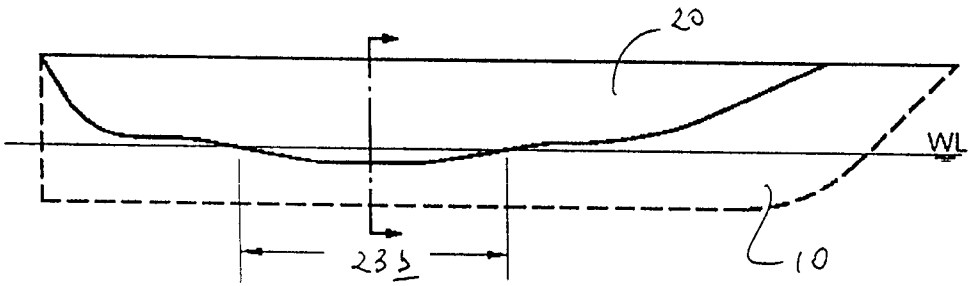
FIG. 7b

FIG. 8a
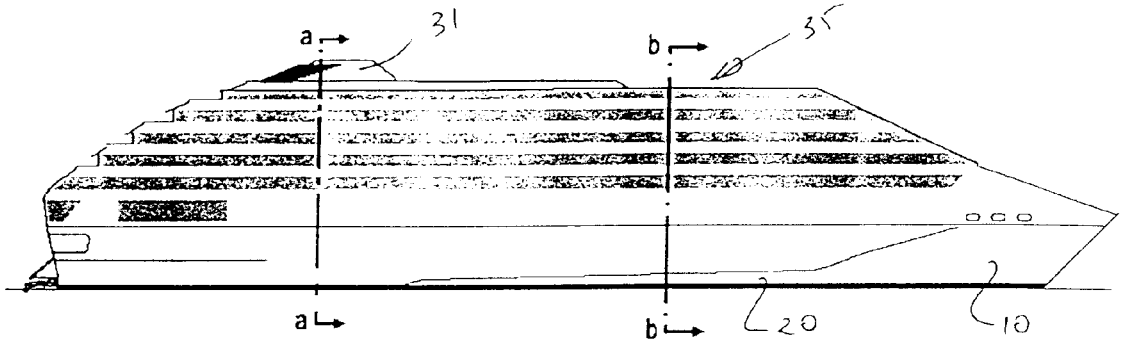
FIG. 8b
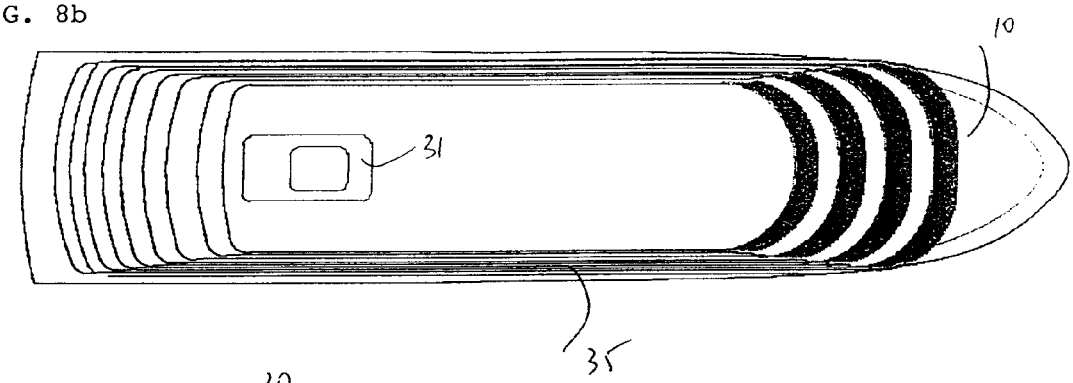
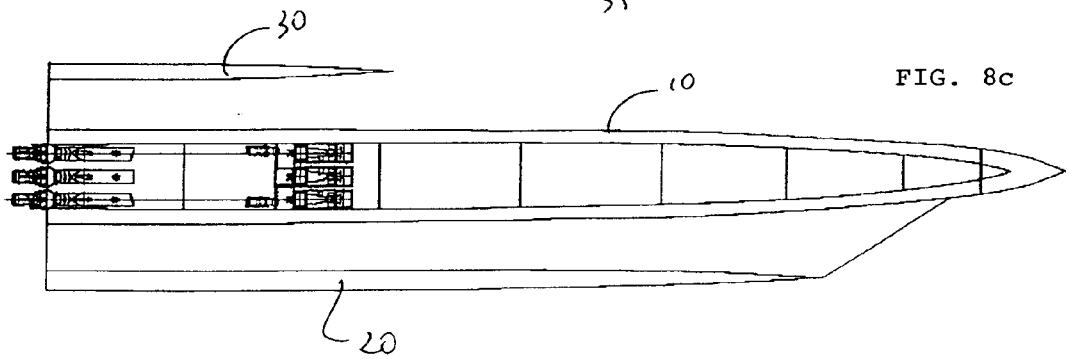
FIG. 8c

SEAGOING VESSELS

INTRODUCTION

This invention relates to multi-hull seagoing vessels and in particular relates to high speed craft with three hulls that can be used to transport passengers and cargo in comfort whilst satisfying maritime stability standards.

International maritime regulations dictate the required stability of seagoing passenger and cargo carrying vessels. With multi-hulled vessels it is often the case that the compliance with the stability standards does not enhance the passenger comfort of the vessels.

It is this conflict between vessel stability and passenger comfort in multi-hull vessels that has brought about the present invention.

BACKGROUND ON BASICS OF STABILITY

When floating at rest in still water, a vessel must obey the following natural conditions:

(i) the force of buoyancy, assumed to act vertically upwards, must equal the total mass of the vessel.

(ii) the point of application of the force of buoyancy, known as the centre of buoyancy, and the centre of gravity of the vessel must be in the same vertical line.

If a vessel is inclined to some small angle from a position of rest and when released it tends to return to the upright position it is said to be stable.

FIG. 1 shows a representative section through a ship inclined at some angle θ to the vertical. The centre of buoyancy B in the upright position has moved to a new position B1. The vessel weight W acts downwards through the centre of gravity G, and the buoyant forces act upwards through B1. Consequently there is a couple tending to return the vessel to the upright position, where this righting couple is given by W.GZ, where the distance GZ is the righting lever. The righting couple can also be written as W.GM Sin θ where M, called the metacentre, is the position of the intersection of the line of action of the buoyancy force acting vertically upwards, and the centre line of the vessel.

It is clear from FIG. 1 that the couple acts to restore the vessel to an upright position only when M is above G, and in this case the vessel is stable. If M is below G, then the couple will act to overturn the vessel, and it is unstable.

If M is above G, then the distance GM has a positive value, and it can be said that a vessel with a positive GM will be stable.

The righting lever GZ can be calculated from the geometry of the vessel together with the vertical height of the centre of gravity G. This can be done at various angles of heel of the craft to produce what is known as a GZ curve, illustrated in FIG. 2. It can be shown that a line drawn at a tangent to the GZ curve at zero angle of heel is equal to the value of GM at the position where the line intersects with an angle of heel of one radian (57.3°).

BACKGROUND ON THE STABILITY REQUIREMENT OF SHIPS

All vessels are required to meet a particular standard of stability. In many cases, and particularly for those vessels carrying passengers, the requirements are laid down by law. For vessels operating on a voyage between two countries, known as an international voyage, the regulations are formulated by the International Maritime Organization (IMO) by Resolution A.749(18), and published by the IMO in a booklet called "Code on Intact Stability for All Types of Ships Covered by IMO Instruments", dated 1995.

These criteria include a requirement to meet a particular condition where the vessel is operating in severe weather and has rolled to windward under the action of waves and then been blown by a gust of wind to leeward. (See Section 3.2 of A.749(18)). In this situation, the regulations describe the total energy of the vessel during the roll to leeward, and compare it with the reserve of energy resisting the roll as the vessel heels further and further to leeward. The energy is described in the following way:

The energy in the vessel when rolling to windward is given by the area a) which is circumscribed by the following three lines:

1. A horizontal line representing the wind gust heeling lever, which is described as 50% greater than the wind heeling lever calculated from the prescribed pressure of the wind acting on the side profile of the vessel,
2. a vertical line representing the angle of roll to windward calculated from a prescribed formula and measured from the angle resulting from the wind heeling lever where it intersects the GZ curve, and
3. the GZ curve between the previously-described two lines.

This area is known as area a.

The energy resisting the vessel roll is given by the area b, which is circumscribed by the following three lines:

1. A horizontal line representing the wind gust heeling lever, which is described as 50% greater than the wind heeling lever calculated from the prescribed pressure of the wind acting on the side profile of the vessel,
2. a vertical line representing the angle at which water starts to flood the vessel and known as the downflooding angle, or 50° if this is less than the downflooding angle, and
3. the GZ curve between the previously-described two lines.

The area b under all circumstances must be equal to or at least greater than area a.

The areas a and b are illustrated in FIG. 3.

As can be seen from an examination of FIG. 3, the areas a and b are substantially linked to the value of GM. If GM is decreased, then the GZ curve associated with it is lowered, and the area b is reduced whilst the area a may be increased. As a result of this association, the requirements of the severe wind and weather criterion can usually only be met by having a high value of GM, usually several metres, and considerably greater than the minimum amount allowed by regulation which is 0.15 m. This is particularly onerous for large passenger vessels which typically have large and high superstructures providing a large profile area and hence a large wind heeling lever. This feature increases the area a and decreases area b, and the GM has to be considerably larger than is desirable for such vessels.

This desirability is because the GM value is directly related to the comfort of the vessel. The period taken for the vessel to roll to one side under the action of a wave and then to roll back can be expressed as:

$$\text{Roll period } T_R = 2K_R/\sqrt{GM},$$

where $K_R$ is the transverse polar radius of gyration, and the units are seconds and metres. It can be seen from inspection of the above formula that for a given vessel with a fixed $K_R$, then a high value of GM leads to a correspondingly low value of $T_R$, and a low roll period results in high values of transverse accelerations as the vessel rolls.

Rapid transverse accelerations are directly associated with discomfort for passengers on board a vessel, and therefore to ensure passenger comfort the value of GM must be kept at a low value.

In summary, the severe wind and weather stability criteria dictates a high value of GM, but this in turn results in a higher rolling acceleration and reduced comfort level for persons on board a passenger vessel.

It is possible to manipulate the geometry of the vessel to slightly change the shape of the GZ curve, and hence the areas a and b, which in turn allows for a small reduction in GM. For a vessel having a single hull, which covers the great majority of vessels afloat, one such shape would involve blisters on each side of the craft, which are also called pontoon sides. Another solution, which has been adopted by some designs, involve large overhangs of the ship sides such that the side plating passes through the plane of the water surface at an acute angle, and the ship is considerably wider above the plane of the water than the width at the plane of the water. In this way as the vessel heels it immerses a considerable volume on the submerged side. This partial solution is typical of several large passenger cruise liners.

None of the above solutions are completely satisfactory, because they introduce slamming problems, where the water surface, under the action of waves, impacts on the undersides of the parts that are above the static waterline, creating structural impact loads and creating noise which disturbs the passengers. In addition the effect upon the GZ curve and GM value are not large.

It is practically impossible to reduce the GM value for a vessel having two hulls such as a catamaran, as these craft inherently have very high values of GM owing to the wide separation of the waterplane of the two hulls.

Definitions

The design draught is defined as the position of the waterline at which the vessel is designed to float during the normal operation of the vessel, and may include a range of waterlines depending upon the loading of the vessel and the usage of consumables such as fuel and fresh water. These waterlines may include different trims, where the waterline is not parallel to the baseline of the vessel in the longitudinal direction.

The waterplane of a vessel floating at rest at a draught T is defined as the shape defined by the intersection of the exterior hull shape and a horizontal plane at the water surface. This waterplane will have an area, $A_{WP}$, and an associated moment of inertia $I_T$ about a longitudinal axis running from the bow to the stern on the centreline of the vessel.

SUMMARY OF THE INVENTION

In accordance with one aspect of the present invention there is provided a seagoing vessel having a length of between 45 and 175 metres and designed to operate at speeds between 25 and 70 knots, the vessel comprising a single hull with stabilising side hulls (called amahs) positioned on each side of the hull, the ratio of the moment of inertia of the water plane $I_T$ to the volume of displacement $\nabla$ (in consistent units) is equal to a value of between 1.0 and 6.0 and the vessel being shaped above the designed water line such that the righting lever (GZ) curve as the vessel heels results in a righting lever (GZ) curve that meets the following requirements:

$$b \geqq a$$

Preferably the main hull is designed so that the distance GM determined in the transverse plane for the main hull in isolation and without amahs but floating at a water line equivalent to that for the complete vessel is less than 0.15 metres or negative. The amahs may be designed such that each has a volume of displacement of less than 10%, preferably less than 5% of the total volume of displacement including the main hull.

In accordance with a further aspect of the present invention there is provided a seagoing vessel having a length of between 45 and 175 metres and designed to operate at speeds of between 25 and 70 knots, the vessel comprising a single hull with stabilising amahs positioned on either side, wherein the hydrostatic value of GM determined in the transverse plane lies between 0.5 and 5 metres, the vessel being shaped above the designed waterline such that the righting lever (GZ) curve as the vessel heels meets the following requirements:

the area (b) bounded by the GZ curve plotted on the heeling axis between the angle of flooding and the heeling lever associated with a specific gust of wind is greater in value than the area (a) bounded by the GZ curve plotted on the heeling axis between the heeling lever associated with the specific gust of wind and an angle associated with the amount of roll of the vessel to windward under the action of the waves.

DESCRIPTION OF THE DRAWINGS

Embodiments of the present invention will now be described by way of example only with reference to the accompanying drawings in which:

FIGS. 6*a* to 6*c* are schematic illustrations of hull shapes viewed in cross section taken at the middle of the underwater part of the amahs and illustrating various methods of increasing the water plane area above the design waterline, FIGS. 7*a* and 7*b* are side views of the hull with amahs at the aft end (a) and after part (b), FIGS. 8*a*, 8*b* and 8*c* are respectively side elevational plan and sectional views of a 150 metre long passenger cruise vessel in accordance with the preferred embodiment.

PREFERRED EMBODIMENTS

Figure 3:
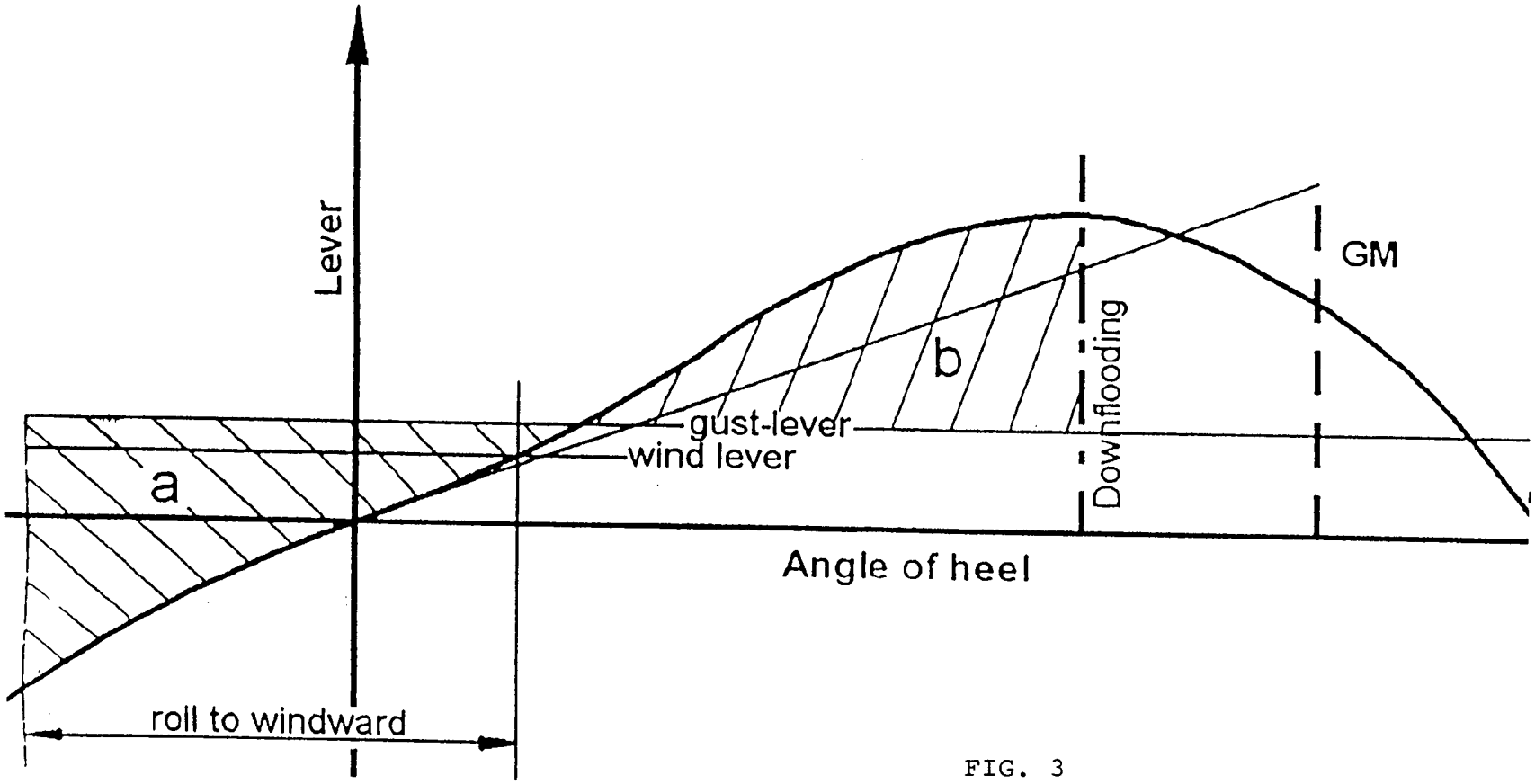
FIG. 3 is a graph of lever against angle of heel known as a GZ curve illustrating areas a and b for use in determining performance in severe wind and weather.
Figure 4A:
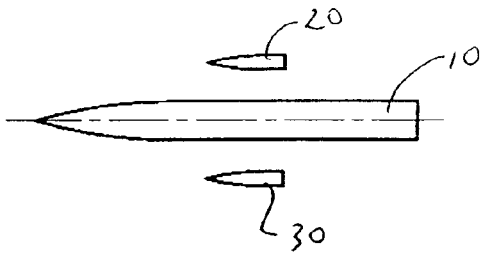
FIGS. 4*a* to 4*f* are plan views at the waterline of various amah configurations in accordance with embodiments of the invention.
Figure 4B:
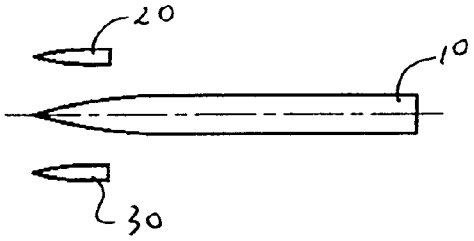
Figure 4C:
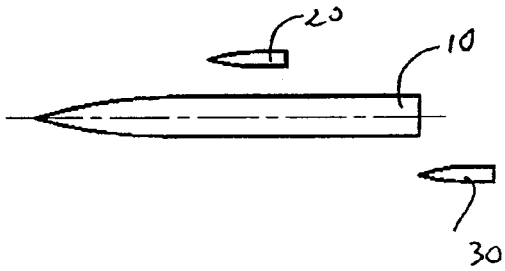
Figure 4D:
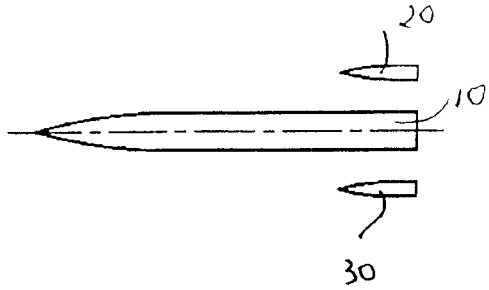
Figure 4E:
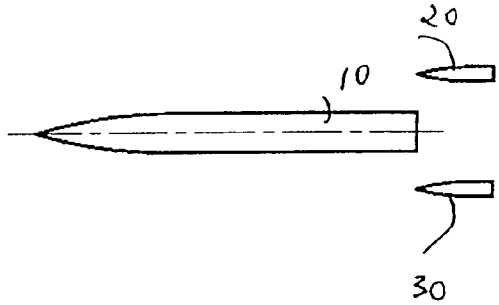
Figure 4F:
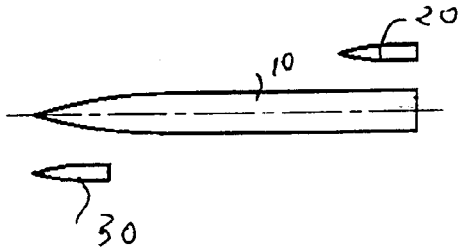

The invention that is the subject of this application relates to a multi-hull seagoing vessel that usually operates at speeds between 25 and 70 knots. The vessel is between 45 and 175 metres in length and the ratio of the moment of inertia of the water plane $I_T$ to the volume of displacement $\nabla$ (in consistent units) is equal to a value of between 1.0 and 6.0. In the hull shape described below, the area b in FIG. 3 is manipulated such that it is greater than the area a whilst at the same time maintaining a GM value of less than 5.0 metres. A vessel of this kind has the stability to satisfy maritime standards with considerably increased passenger comfort levels.

The vessel 1 is essentially a three-hulled craft having a slender main hull 10 supported on each side by an additional small amah 20, 30, the positioning of each amah 20, 30 relative to the main hull 10 may vary considerably as is illustrated in FIG. 4. FIG. 4 show the amahs in plan at the waterline wherein in FIG. 4*a* the amahs 20, 30 are at midships of the main hull 10; in FIG. 4*b* the amahs 20, 30 are at the forward end of the main hull 10; in FIG. 4*c* the amahs 20, 30 are staggered along the rear half of the main hull 10; in FIG. 4*d* the amahs 20, 30 line up with the transom; in FIG. 4*e* the amahs 20, 30 are behind the main hull 10; and in FIG. 4*f* the amahs 20, 30 are staggered along the full length of the main hull 10.

The main hull 10 on its own has a GM value that is less than 0.15 metres or in some situations G can actually be positioned above M which would introduce instability but for the presence of the amahs. The size of the amahs 20, 30 is such that the volume of displacement of each amah with the vessel lying at the designed draft with zero angle of heel is less than 5% of the displacement of the main hull. The waterplane at the moment of inertia $I_T$ of the total craft including the amahs 20, 30 is such that the ratio $I_T$ divided by $\nabla$ (in consistent units) has a value of between 1.0 and 6.0.

A vessel having these characteristics may be expected to have a motion when rolling under the action of waves that is considerably more comfortable than a multihull having a higher ratio.

If the waterplane area coefficient Cwp is described as the ratio of the total area $A_{WP}$ of the waterplane including the side hulls at a draught T, to the product of the length of the main hull and the beam of the main hull at the design waterline, then . . .

$$C_{WP} = \frac{A_{WP}}{\text{Mainhull length} \times \text{mainhull beam}}$$

Figure 5:
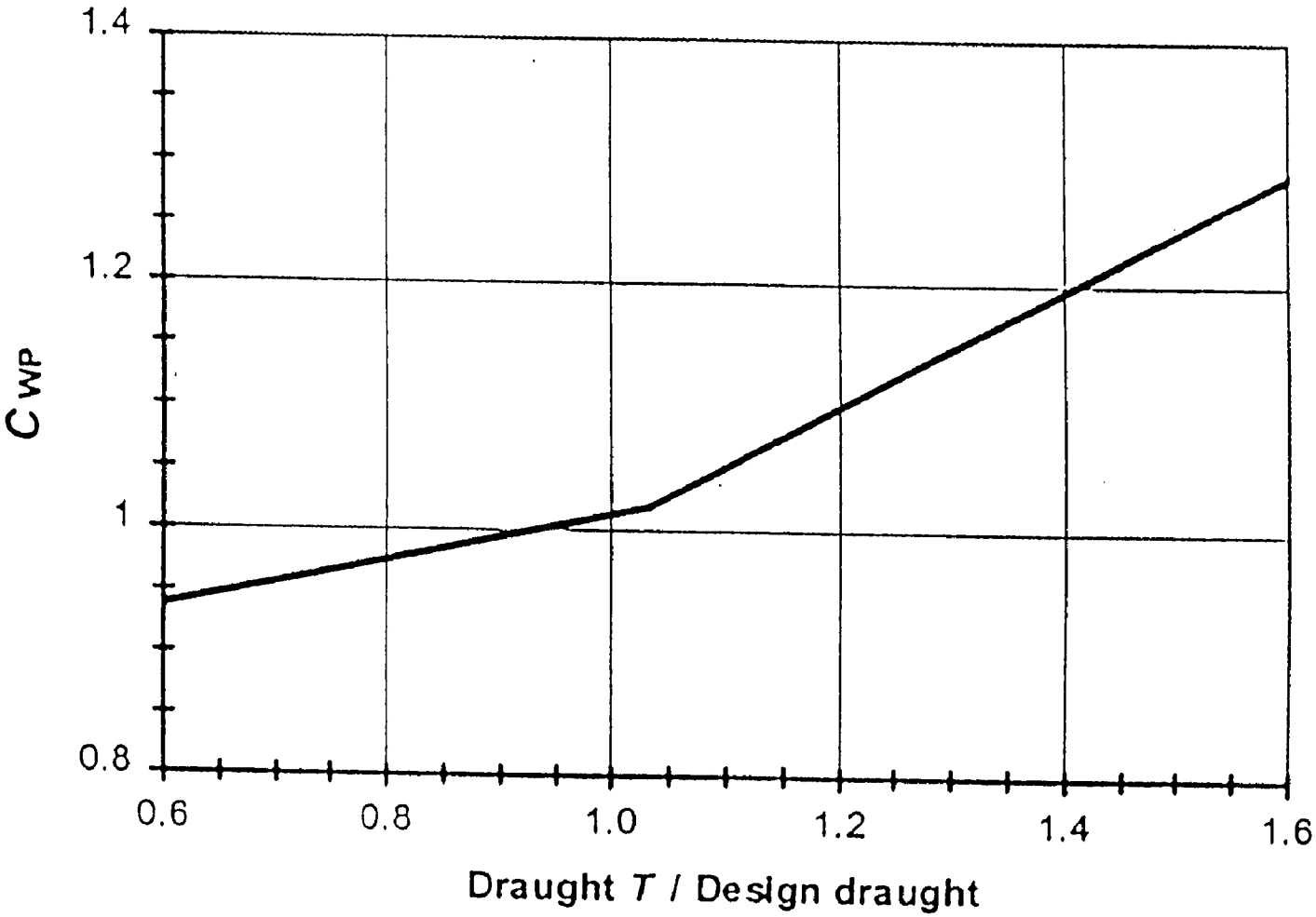
FIG. 5 is a graph of waterplane area coefficient (Cwp) against draft showing the sudden increase in Cwp at or just above the design draft.

Below the waterplane at the design draught, the value of $C_{WP}$ will increase as the draught increases. Above the design draught, the volume of the amah increases substantially and becomes an effective side hull. The rate of increase of the value of $C_{WP}$ as the draught continues to increase above the design waterline will become approximately double that of the rate of increase below the design draught, as illustrated in FIG. 5.

This rapid increase in Cwp is brought about by increasing either the length of the amahs or the beam of the amahs, or both the beam and the length, as illustrated in FIGS. 6 to 9. FIGS. 6*a*, 6*b* and 6*c* are cross sectional views of the vessel taken at the middle of the submersed portion of the amahs illustrated in FIGS. 7*a* and 7*b* and illustrating the above water profile of the amahs and the various shapes of tunnel 15 that they define on either side of the main hull 10. FIGS. 7*a* and 7*b* are side elevational views that show alternative positioning of the amahs. In FIG. 7*a* the underwater portion 23*a* of the amah 20 is at the aft end of the vessel. In FIG. 7*b* the amah 20 is in the after part of the rear of the vessel, forward of the stern with the underwater portion indicated as 24*b*. In FIGS. 7*a* and 7*b* the profile of the amahs 20 is shown in full line whilst the profile of the main hull 10 is shown in dotted profiles. FIG. 9*a* is a cross sectional view taken along the lines a—a of FIG. 8 and FIG. 9*b* is a cross sectional view taken along the lines b—b of FIG. 8*a* and show the above water shapes of the amahs 20, 30 defining the tunnels 15 on either side of the main hull 10. The cross sectional views also show the tiered decking 35 of the vessel with FIG. 9*a* showing the central funnel 31 that serves as both an air intake and exhaust for the engines of the vessel. The necking portion 32 as shown in FIG. 9*a* is an area of decking to accommodate life boats. Where the length of the amah is increased, this is done gradually and without a step. This feature is evident from FIG. 8*a*. FIG. 8*c* is a plan view of the vessel taken primarily at the waterline but showing the starboard amah 20 above the waterline illustrating how the above water portion of the amah extends for substantially three quarters of the length of the vessel.

Figure 1:
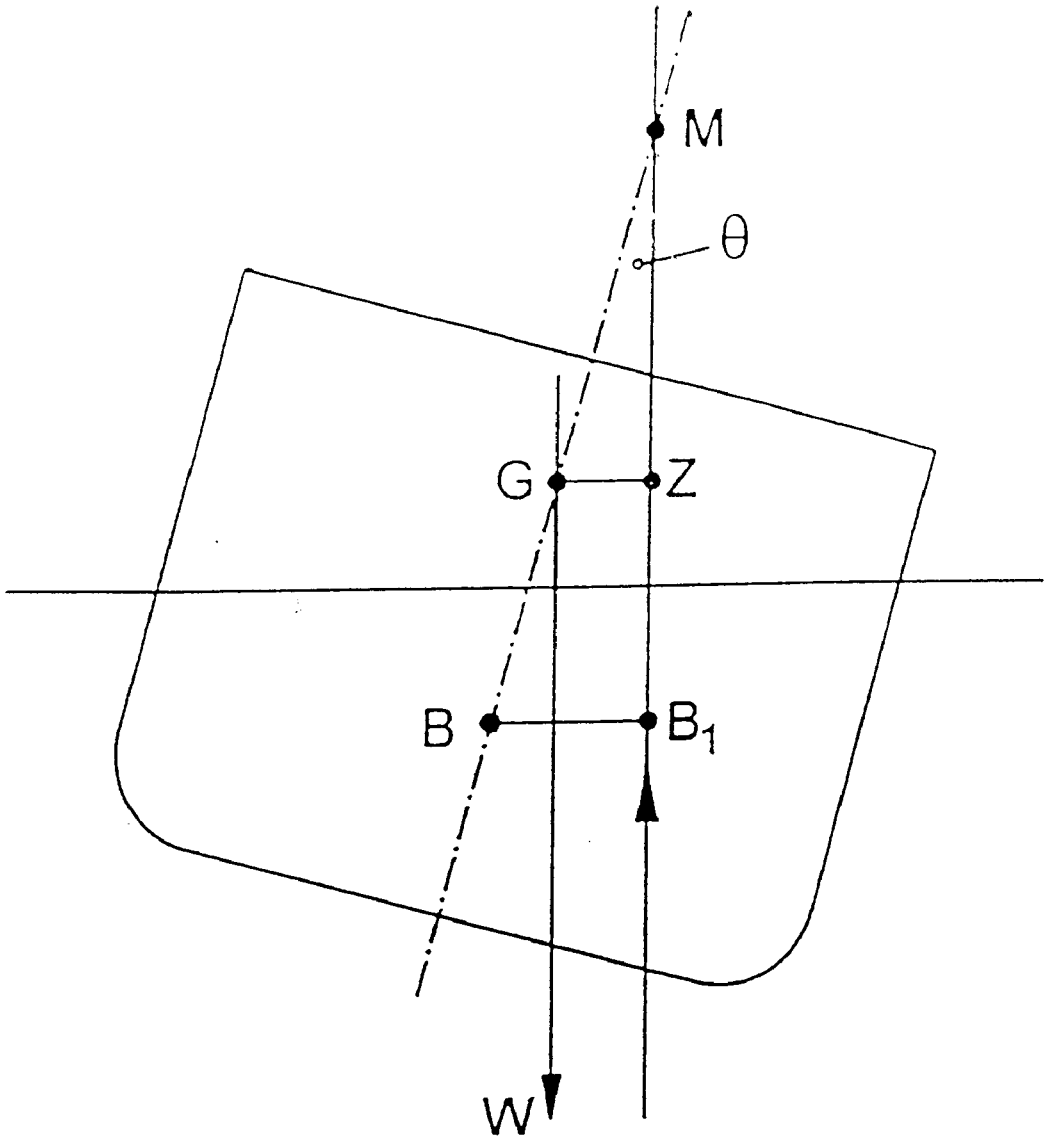
FIG. 1 is a diagram illustrating nomenclature discussed in the background on basics of stability.
Figure 2:
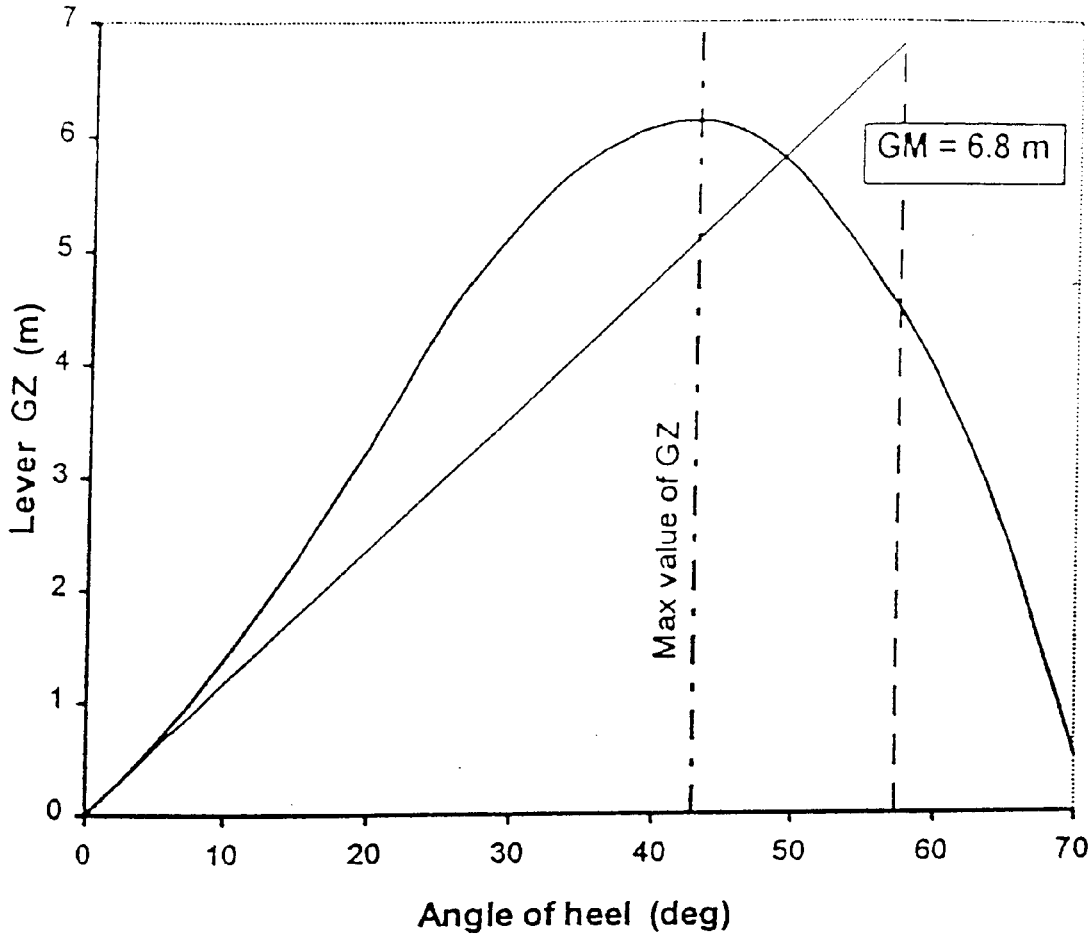
FIG. 2 is a graph of lever GZ against angle of heel known as a GZ or righting lever curve.

The actual rate of increase of the waterplane area is such that $I_T/\nabla$ also increases, together with the value of the distance GZ, illustrated in FIG. 1. By careful design of the shape above the design waterline, the rate of increase of the waterplane area can be manipulated such that the value of GZ at a specific heel θ can be obtained. In this way the shape of the GZ curve illustrated in FIG. 3 can be defined such that the area b is equal to or greater than the area a.

The increase of waterplane area with this arrangement of a main hull 10 with amahs 20, 30 also allows hull shapes that are not subject to the slamming and noise problems that are evident on conventional single hulls described earlier.

The preferred embodiment illustrated in FIGS. 8*a*, 8*b* and 8*c* is a 150 m long passenger cruise vessel, with cabins suitable for 450 passengers and 230 crew, with propulsion suitable for speeds in excess of 35 knots. The hull comprises of a main watertight structure with a length of 150 metres, and a width at the waterline at the transom of 9 metres. The width at the transom is the widest part on the waterline, and is designed as the minimum practical dimension to accommodate the waterjet propulsion system. The draught of the hull is 5 metres, and represents the minimum permitted by the waterjet propulsion system without allowing ingestion of air into the system when operating at speed.

Figure 10:
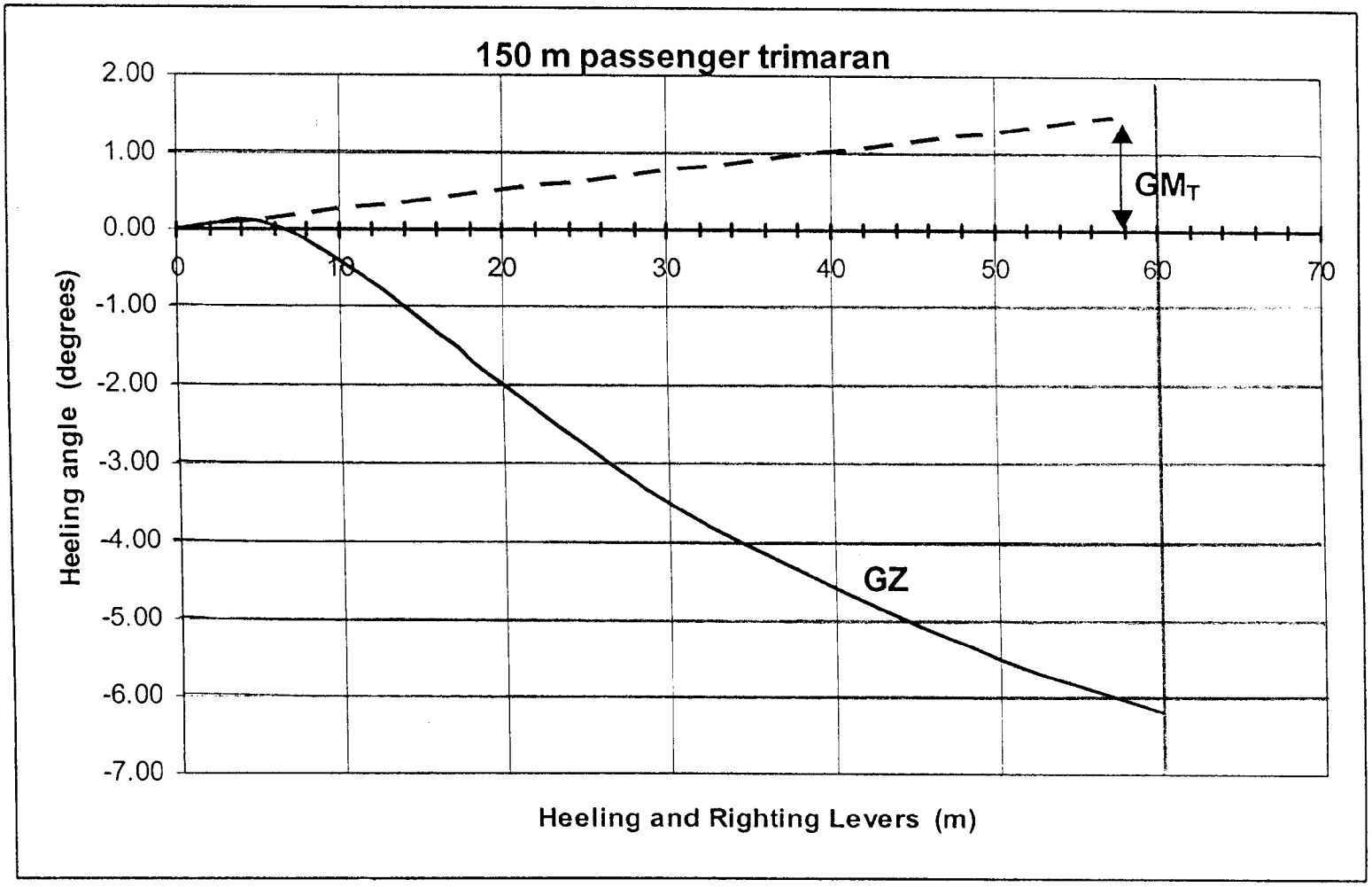
FIG. 10 is a curve of statical stability for a long thin monohull that forms part of the preferred embodiment.

This single hull 10 shape has a waterplane area of 1350 $m^2$ and a transverse moment of intertia of the waterplane (M. of I) is 50000 $m^4$, giving a $GM_T$ value of 1.5 m that will result in excellent comfort levels for passengers, but the stability characteristics do not meet the legislative requirements as described in Code on Intact Stability for All Types of Ships Covered by IMO Instruments (known as Resolution A.749(18)), published by the International Maritime Organisation in London in 1995, and adopted into the legislation of all the ratifying countries. The Curve of Statical Stability for the vessel as so far described, is illustrated in FIG. 10, and is deficient in all areas, (with the exception of the value of $GM_T$), with the vessel having no stability and would therefore capsize if heeled more than 6°.

In order to improve the stability characteristics, amahs 20, 30 are located on either side at the aft end to provide additional righting moment. Each amah 20, 30 has a length on the waterline of 50 metres, and a width of 2.5 metres at the widest point. The underwater shape of each amah is such as to minimise resistance, and the waterplane area and transverse moment of inertia of the waterplane of each amah is such as to provide a minimum resistance whilst providing the desired value of $GM_T$ dictated by passenger comfort.

The displacement of each amah is 200 tonnes when the vessel is fully-laden. The transverse location of the amahs for this craft is chosen so that they are as far apart transversely as possible whilst remaining within the 32 metre overall width permitted by the restriction of the Panama Canal.

Figure 9A:
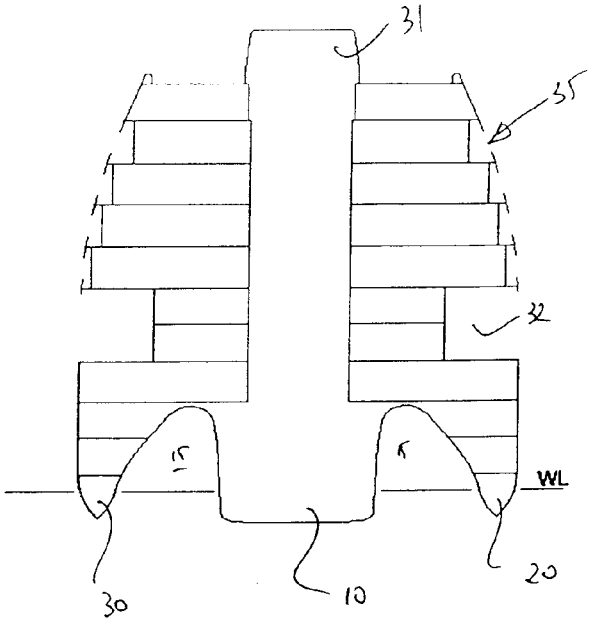
FIGS. 9*a* and 9*b* are cross sectional views taken along the lines a—a and b—b of FIG. 9*a,*
Figure 9B:
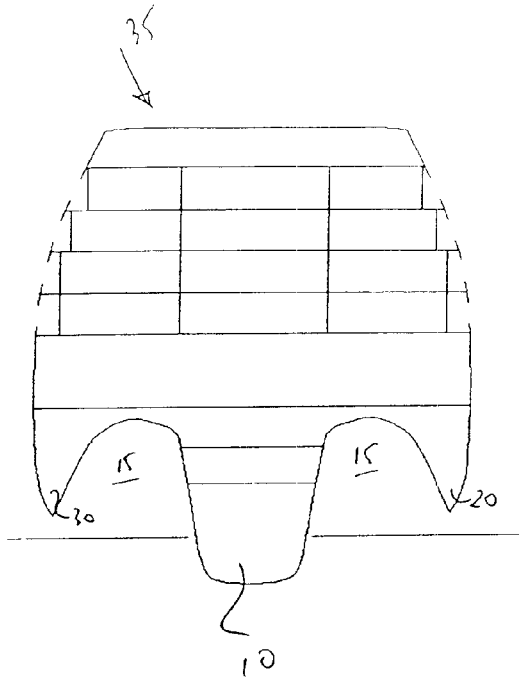

The amahs are connected to the main hull by a continuous watertight structure forming part of the boundary of the vessel, as illustrated by the sections in FIGS. 9*a* and 9*b*.

TABLE 1

| Principal Characteristics of the complete design | |
|---|---|
| Length overall | 155 m |
| Length waterline | 145 m |
| Beam main hull | 9 m |
| Beam overall | 32 m |
| Draught | 5 m |
| Number of decks | 9 |
| Fuel | 750 t |
| Fresh water | 500 t |
| Ballast | 500 t |
| Displacement | 4700 t |
| Vertical centre of gravity | 12 m |

In order to maximise the comfort of the passengers it is necessary to limit the value of $GM_T$. For this craft when fully laden, a value of 2.0 metres was chosen, as this would provide a long rolling period and slow roll with low acceleration levels, thus permitting ease of passenger movement. At a design displacement of 4700 tonnes, to achieve this value of $GM_T$ requires a transverse moment of inertia of the waterplane of 55000 metres$^4$ and a waterplane area of 1500 square metres. These requirements of displacement and waterplane area, within the overall dimensions previously described and summarised in Table 1, determine the shape of the centre hull and amahs along the waterline, which are illustrated by the body plan of FIG. 11.

Figure 11:
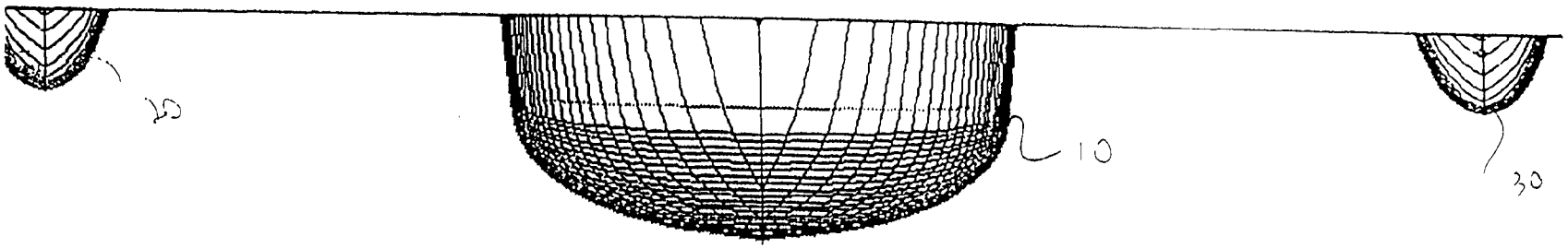
FIG. 11 is a body plan of the underwater shape of the hull of the preferred embodiment.

The underwater hull shapes illustrated in FIG. 11 provide a $GM_T$ value of 2.0 metres, which is well above the minimum allowable of 0.15 metres, but generally insufficient to meet the severe wind and weather criteria, or the passenger heeling criteria, of the regulations without radical changes to the above water hull form.

Above the waterline, the inboard sides of the amah are flared inwards towards the main hull at angles varying between 10° and 20° depending upon the location, although these may be gently curved shapes rather than a straight line for structural manufacturing reasons, and then to become horizontal at a height above the waterline of 7.0 metres. This height above the waterline, called the tunnel height, is chosen to minimise the impact of waves on the tunnel structure.

Above the waterline, the amahs are extended forwards in a continuous curved line, so that at a height of 0.5 meters above the design waterline the length of the amahs has increased from 50 metres to 125 metre. The result of this is that if the vessel heels by 5 degrees, then the waterplane transverse moment of inertia increases rapidly to 65000 metres$^4$, an increase of over 10% above the zero heel case.

Figure 12:
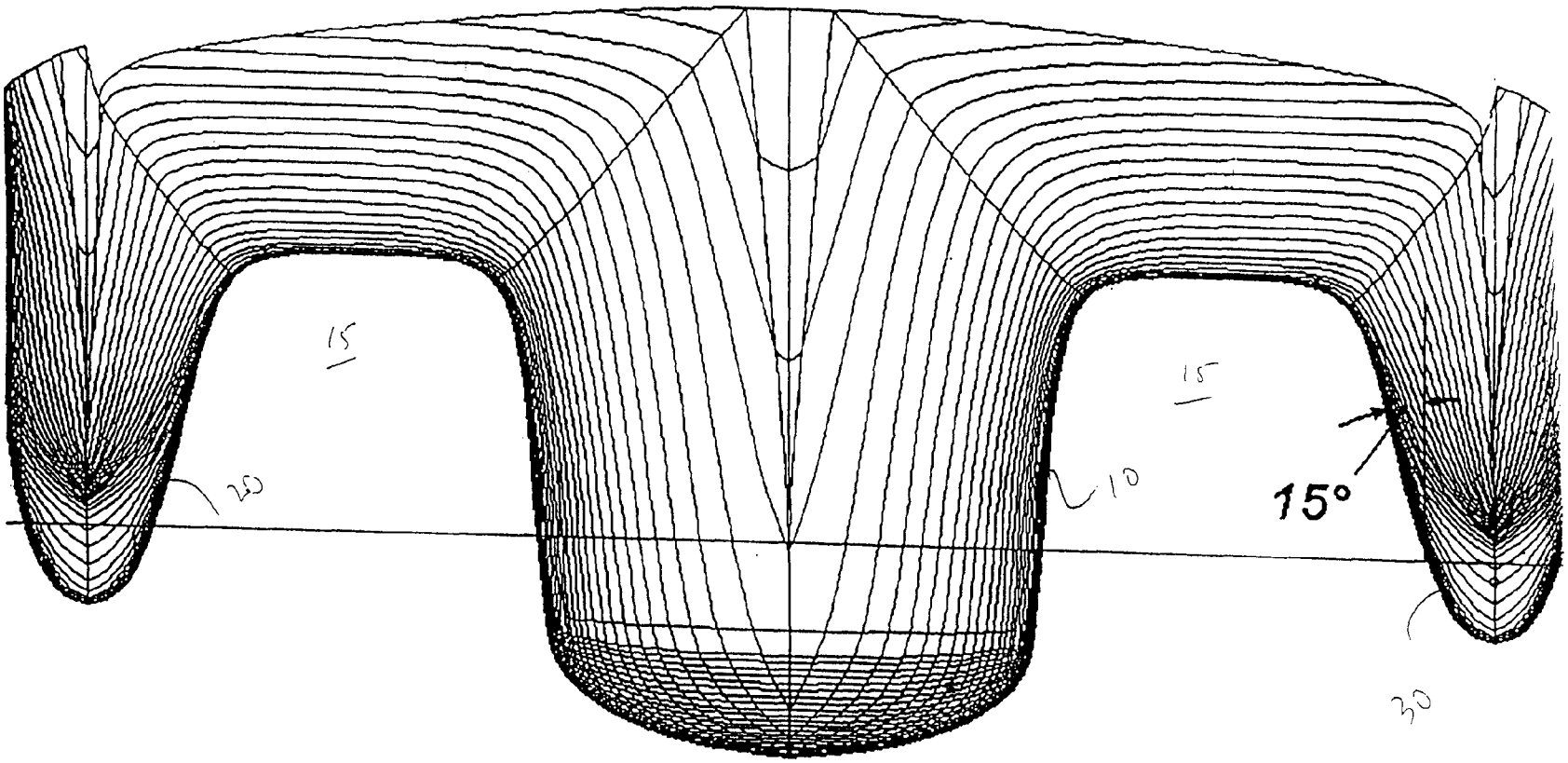
FIG. 12 is a body plan of the total hull illustrating a flare on the inboard side of the amahs above the waterline.

The complete hull is illustrated in the body plan of FIG. 12.

The shape of the extension of the amahs forward, together with the inboard flare of the amah side shell, determines the ordinates of the GZ curve as the vessel heels to various angles. The shape forward and the inboard flare are adjusted from the vertical so that the GZ curve is the required shape and size, such that it meets all the legislative requirements, particularly the comparison of areas a and b concerned in the calculation of Severe Wind and Rolling performance contained in Resolution A.749(18) and illustrated in FIG. 3.

The exact method by which this is achieved is as follows:

The desired GZ curve is drawn having the desired $GM_T$ value (in this case 2.0 m) and having the characteristic shape to provide the necessary areas beneath this curve to meet the regulatory requirements. This curve represents the minimum GZ values that allow the requirements to be met.

At a specific heel angle (say 5°) the required GZ is obtained from the minimum GZ curve. The waterplane shape of the amah is manipulated to give the desired area and inertia and hence the desired value of GZ. This defines the hull shape at this one angle (say 5°). The angle is increased (to say 10°) and the process repeated.

In this way the shape of the amah is determined at various angles of heel.

For this preferred embodiment, the increase in waterplane area and transverse moment of inertia of the waterplane has been accomplished by extending the amah longitudinally and also by angling the inboard side of the amah, as illustrated in FIG. 6*b*. It could equally have been achieved by angling both the inboard and outboard sides of the amah, as shown in FIG. 6*a*. It could also have been achieved by angling the inboard side of the amah and the outboard side of the main hull, as illustrated in FIG. 6*c*. The choice to only angle the inboard side of the amahs for the preferred embodiment was made to suit practical construction constraints for this particular design.

For the preferred embodiment, the submerged part of the amahs were located at the after end of the vessel to suit the specific operational needs, see FIG. 7*a*. They could equally well have been placed further forward, as illustrated in FIG. 7*b* without affecting the stability characteristics or the approach taken.

For the preferred embodiment the result was an inboard flare that gently curved representing an approximate angle of 15° from the vertical, and the amahs were extended forward by a further 150% of the length on the waterline.

Figure 13:
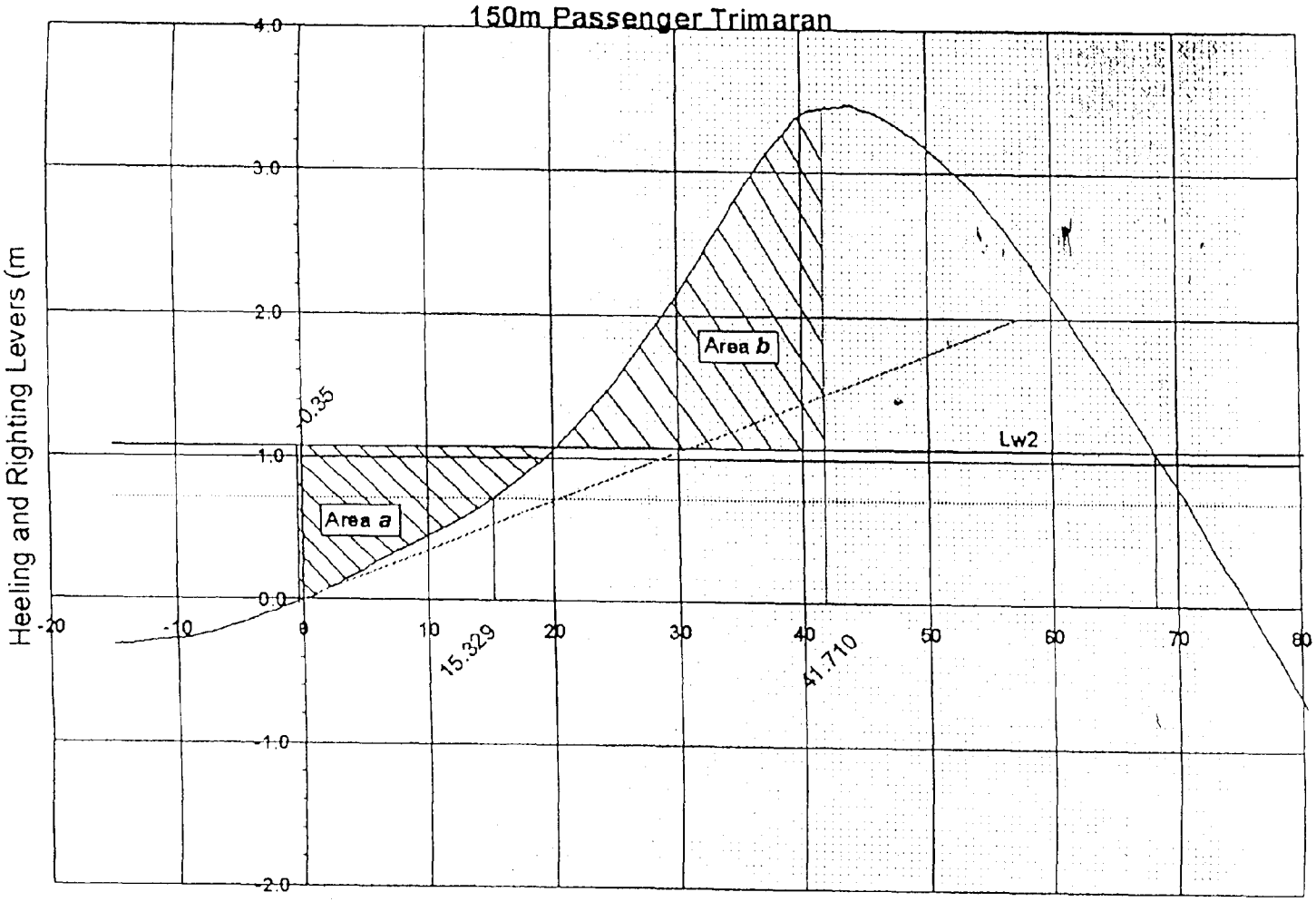
FIG. 13 is a GZ curve of the 150 m length monohull with amahs.

The GZ curve of this completed design is illustrated in FIG. 13. The curve meets the legislative requirements of areas under the curve, as illustrated in Table 2.

TABLE 2

Stability Characteristics of the final design

| IMO Requirement | | Actual | |
|---|---|---|---|
| Area 0°–30° | min. 0.055 | 0.43 m-rad | PASS |
| Area 0°–4°– | min. 0.09 | 0.93 m-rad | PASS |
| Area 30°–40° | min. 0.03 | 0.49 m-rad | PASS |
| $G_FZ$ value @ 30 | min. 0.2 | 2.14 m | PASS |
| Angle of Heel @ $G_FZ_{MAX}$ | min. 25 | 44 degrees | PASS |
| $G_FM_O$ | min. 0.15 | 2.00 m | PASS |
| Area a | | 0.23 m-rad | |
| Area b | Area b > a | 0.43 m-rad | PASS |
| Heel Due to Wind Heeling | 16 | 15.3 | PASS |
| Heel Due to Pax Crowding | max 10 | 2.7 degrees | PASS |
| Heel due to Turning | max. 10 | 9.9 degrees | PASS |

What is claimed is:

1. A seagoing vessel having a length of between 45 and 175 metres and designed to operate at speeds of between 25 and 70 knots, the vessel comprising a single main hull with stabilising amahs positioned on either side, wherein the hydrostatic value of GM determined in the transverse plane lies between 0.5 and 5 metres, the vessel being shaped above the designed waterline such that the righting lever (GZ) curve as the vessel heels meets the following requirements:

the area (b) bounded by the GZ curve plotted on the heeling axis between the angle of flooding and the heeling lever associated with a specific gust of wind is greater in value than the area (a) bounded by the GZ curve plotted on the heeling axis between the heeling lever associated with the specific gust of wind and an angle associated with the amount of roll of the vessel to windward under the action of the waves.

2. The seagoing vessel according to claim 1, wherein the moment of inertia of the water plane $I_T$ to the volume of displacement $\nabla$ (in consistent units) is equal to a value of between 1.0 and 6.0.

3. The seagoing vessel according to claim 1, wherein the distance GM determined in the transverse plane for the main hull in isolation and without amahs but floating at a water line equivalent to that for the complete vessel is less than 0.15 metres of negative.

4. The seagoing vessel according to claim 1, wherein each amahs has a volume of displacement of less than 10% of the total volume of displacement including the main hull.

5. The seagoing vessel according to claim 1, wherein above the waterline the inboard side of each amah is flared inwardly towards the single hull at an angle of between 10 and 20 degrees.

6. The seagoing vessel according to claim 5, wherein the flared inboard sides of the amahs merge into a horizontal surface that is at a height about 7 metres above the waterline.

7. The seagoing vessel according to claim 1, wherein the amahs are extended forwardly in a continuously curved line so that at a height of 0.5 metres above the design waterline the length of the amahs is increased by approximately 150%.

8. The seagoing vessel according to claim 1, wherein each amah has a volume of displacement of less than 5% of the total volume of displacement including the main hull.

9. The seagoing vessel according to claim 1, wherein the water plane area coefficient Cwp increases as the draught increases below the water line and the rate of increase of Cwp as the draught increases above the water line is approximately double that of the rate of increase below the water line.

10. The seagoing vessel according to claim 1, wherein the hydrostatic value of GM is 2 metres.

11. The seagoing vessel according to claim 1, wherein the amahs are positioned on either side of the after part of the main hull.

12. The seagoing vessel according to claim 11 wherein at the waterline the amahs extend to approximately a third of the length of the main hull and above the waterline the amahs extend to about 75% of the length of the main hull.

13. The seagoing vessel according to claim 1, wherein the maximum width of the vessel is 32 metres.

* * * * *